US011047072B2

(12) United States Patent
Pacheriwala

(10) Patent No.: US 11,047,072 B2
(45) Date of Patent: Jun. 29, 2021

(54) WOVEN FABRIC, A COMPOSITION OF THE WOVEN FABRIC AND A WEAVING METHOD THEREOF

(71) Applicant: Vishal Pacheriwala, Mumbai (IN)

(72) Inventor: Vishal Pacheriwala, Mumbai (IN)

(73) Assignee: Vishal Pacheriwala, Mumbai (IN)

( * ) Notice: Subject to any disclaimer, the term of this patent is extended or adjusted under 35 U.S.C. 154(b) by 85 days.

(21) Appl. No.: 16/266,585

(22) Filed: Feb. 4, 2019

(65) Prior Publication Data

US 2020/0181812 A1 Jun. 11, 2020

(30) Foreign Application Priority Data

Dec. 6, 2018 (IN) ..... 201821046114

(51) Int. Cl.
*D03D 13/00* (2006.01)
*D03D 15/00* (2021.01)
*D03D 25/00* (2006.01)

(52) U.S. Cl.
CPC ..... *D03D 13/004* (2013.01); *D03D 15/00* (2013.01); *D03D 25/005* (2013.01)

(58) Field of Classification Search
CPC ..... D10B 2201/02; D10B 2331/04; D10B 2503/06; D10B 2201/04; D10B 2503/062; D10B 2505/08; D03D 15/00; D03D 13/008; D03D 1/0017; D03D 1/00; D03D 47/30; D03D 47/3046; D03D 47/3066; D03D 15/0061; D03D 15/0077; D03D 15/0094; D03D 23/00; D03D 2700/0137; D03D 13/004; D03D 25/005; D03D 2331/04; D03D 2201/02; D03D 47/38; A47G 9/0238; Y10T 442/3268; Y10T 428/1362; Y10T 442/30; Y10T 442/322; Y10T 442/3228; Y10T 442/3285
See application file for complete search history.

(56) References Cited

U.S. PATENT DOCUMENTS 4,100,725 A * 7/1978 Magel ..... D02G 1/164 28/276
4,191,221 A * 3/1980 Boyer ..... D02G 3/36 139/426 R
4,352,380 A * 10/1982 Owen ..... D02G 3/36 139/416
4,496,619 A * 1/1985 Okamoto ..... D01D 5/36 139/391
4,578,306 A * 3/1986 Heiman ..... D02G 3/04 442/214
4,670,326 A * 6/1987 Heiman ..... D03D 15/00 139/420 A
5,487,936 A * 1/1996 Collier ..... D03D 15/00 428/903
5,495,874 A * 3/1996 Heiman ..... D03D 15/00 139/420 A
5,524,841 A * 6/1996 Rijk ..... B65H 54/2836 242/472.8

(Continued)

*Primary Examiner* — Robert H Muromoto, Jr.
(74) *Attorney, Agent, or Firm* — Shumaker, Loop & Kendrick, LLP

(57) ABSTRACT

A woven fabric includes from 50 to 82 ends per inch warp yarns and from 300 to 1200 per inch polyester weft yarns. The woven fabric is made of polyester yarns having a denier of 10 to 60. The warp yarns are made of cotton yarn. The yarn count on the warp is within a range of 20-40 Ne.

16 Claims, 2 Drawing Sheets

(56) References Cited

U.S. PATENT DOCUMENTS 5,843,542 A * 12/1998 Brushafer ..... F16L 11/02 428/36.1
7,445,177 B2 * 11/2008 Wittmann ..... B65H 75/12 242/125.1
8,186,390 B2 * 5/2012 Krishnaswamy .... D03D 13/008 139/420 A
9,131,790 B2 * 9/2015 Agarwal ..... A47G 9/0238
9,474,395 B2 10/2016 Garg et al.
9,481,950 B2 * 11/2016 Agarwal ..... D03D 47/3066
9,493,892 B1 * 11/2016 Agarwal ..... D03D 13/008
9,708,737 B2 * 7/2017 Agarwal ..... D03D 13/004
10,066,324 B2 * 9/2018 Agarwal ..... D03D 13/004
10,428,445 B2 * 10/2019 Agarwal ..... D03D 15/0027
10,443,159 B2 * 10/2019 Agarwal ..... D03D 47/30
10,472,744 B2 * 11/2019 Agarwal ..... D03D 13/008
10,669,651 B2 * 6/2020 Gupta ..... D03D 13/008
2004/0055660 A1 * 3/2004 Heiman ..... D03D 15/00 139/420 R
2005/0095939 A1 * 5/2005 Heiman ..... D03D 15/00 442/208
2005/0109418 A1 * 5/2005 Liao ..... D03D 15/08 139/420 R
2006/0014016 A1 * 1/2006 Lardizabal ..... D02G 3/402 428/375
2006/0180229 A1 * 8/2006 Heiman ..... D03D 15/00 139/420 R
2007/0014967 A1 * 1/2007 Tingle ..... D04H 1/56 428/96
2007/0202763 A1 * 8/2007 Shibaoka ..... A45B 25/18 442/203
2008/0057813 A1 * 3/2008 Tingle ..... D03D 15/00 442/203
2009/0260707 A1 * 10/2009 Aneja ..... D03D 13/008 139/420 R
2011/0111666 A1 * 5/2011 Kim ..... D03D 15/0061 442/239
2011/0133011 A1 * 6/2011 Lee ..... B65H 54/026 242/166
2012/0009405 A1 * 1/2012 Krishnaswamy .... D03D 13/008 428/219
2014/0308865 A1 * 10/2014 Kumar ..... D03D 15/08 442/184
2015/0047736 A1 * 2/2015 Agarwal ..... D03D 15/00 139/435.6
2015/0322597 A1 * 11/2015 Agarwal ..... D03D 47/30 139/420 R
2016/0177478 A1 * 6/2016 Agarwal ..... D03D 47/3046 139/420 R
2016/0222554 A1 * 8/2016 Agarwal ..... D03D 15/00
2016/0369433 A1 12/2016 Crawford et al.
2017/0016153 A1 * 1/2017 Agarwal ..... D03D 1/0017
2017/0175303 A1 * 6/2017 Agarwal ..... D03D 13/008
2017/0314169 A1 * 11/2017 Agarwal ..... A47G 9/0238
2018/0298529 A1 * 10/2018 Jhunjhunwala ..... D03D 13/002
2018/0347078 A1 * 12/2018 Goenka ..... D02G 3/44
2018/0371650 A1 * 12/2018 Agarwal ..... D03D 1/0017
2019/0323152 A1 * 10/2019 Ranganathan ..... D03D 1/0017
2020/0032432 A1 * 1/2020 Agarwal ..... D03D 47/3066

* cited by examiner

WOVEN FABRIC, A COMPOSITION OF THE WOVEN FABRIC AND A WEAVING METHOD THEREOF

TECHNICAL FIELD

The present disclosure described herein, in general, relates to textiles, and more particularly, relates to a woven fabric, a composition of the woven fabric and a method of weaving the fabric having enhanced thread count that produces a durable, wrinkle-free, high-strength, soft and affordable fabric.

BACKGROUND

Any fabric, for example, apparel or in home textile is desirable depending upon the characteristics it possesses. For example, one of the important characteristic is the softness and/or luxurious feel the fabric can provide to the wearer wearing the fabric. Further, another characteristic may be the long-lasting ability of the fabric that can withstand to different atmospheric and washing conditions. In the current scenario, a cotton fabric has been a preferable choice for the human due to its characteristic of providing high comfort and feel to the human wearing it. However, the cotton fabric may not withstand different atmospheric and washing conditions and therefore may not be durable. In order to increase the durability of the cotton while maintaining the comfort and the feel, attempts have been made to the weave the cotton in combination of synthetic fiber such as polyester.

In the fabric made of combination of cotton and the polyester, the cotton may be used as warp yarns and the polyester may be used as weft yarns. Typically, a fabric made using polyester yarns with small denier may increase the comfort provided by the fabric. These fine yarns having smaller denier may result in higher thread count. It must be noted herein that a thread count of a textile may be determined by counting the total weft yarns and warp yarns in along two adjacent edges of a square of fabric that is one-inch by one-inch. The thread count may be a commonly recognized indication of the quality of the textile, and the thread count may also be a measure that consumers associate with tactile satisfaction and opulence.

However, fine synthetic weft yarns, such as polyester, may break when fed into a loom apparatus. Cotton-polyester hybrid weaves may, therefore, be limited to larger denier synthetic yarns that the loom may effectively use. Thus, the thread count and its associated comfort and luxury may be limited.

SUMMARY

This summary is provided to introduce aspects related to a woven fabric, a composition of the woven fabric and a weaving method and are further described below in the detailed description. This summary is not intended to identify essential features of the subject matter nor is it intended for use in determining or limiting the scope of the subject matter.

In one embodiment, a woven fabric is disclosed, wherein the woven fabric comprises from 50 to 89 ends per inch warp yarns and from 200 to 1200 yarns per inch polyester weft yarns. In one aspect, the woven textile fabric may be made of polyester yarns having a denier of 10 to 60. In another aspect, the warp yarns may be made of cotton yarn. In yet another aspect, the yarn count on the warp may be within a range of 20-40 count (Ne). In yet another aspect, the fabric may be weaved using air jet insertion apparatus or a rapier pick insertion apparatus.

In another embodiment, a method of weaving a fabric is disclosed. The method may include forming a fabric comprising from 50 to 89 ends per inch warp yarns and from 200 to 1500 yarns per inch polyester weft yarns. According to the method, the yarns are woven into the fabric using multi-filament polyester weft yarn. Additionally, the multi-filament polyester weft yarn is wound on yarn package to enable inserting of the multi-filament polyester weft yarn during a single pick insertion event of a pick insertion apparatus of a loom apparatus. In one aspect, the pick insertion apparatus of a loom apparatus may include an air jet insertion apparatus or a rapier pick insertion apparatus. According to the method, the multi-filament multiple polyester weft yarns are wound on one of a single-strand yarn package or a multi-strand yarn package at an angle of a predefined range 15 to 30 degrees to enable the simultaneous inserting of the multi-filament polyester weft yarns during the single pick insertion event of the pick insertion apparatus of the loom apparatus. The woven fabric comprises from 50 to 89 ends per inch warp yarns and from 200 to 1200 yarns per inch polyester weft yarns. Further, the woven textile fabric may be made of polyester yarns having a denier of 10 to 60. Further, the warp yarns may be made of cotton yarn. Furthermore, the yarn count on the warp may be within a range of 20-40 count (Ne).

In another aspect, a method of weaving a fabric includes drawing multiple polyester weft yarns from a weft source to a pick insertion apparatus of a loom apparatus. The method also includes conveying by the pick insertion apparatus the multiple polyester weft yarns across a warp shed of the loom apparatus through a set of warp yarns in a single pick insertion event of the pick insertion apparatus of the loom apparatus. Further, the method includes beating the multiple polyester weft yarns into a fell of the fabric with a reed apparatus of the loom apparatus such that the set of warp yarns and/or the multiple polyester weft yarns become interlaced into a woven textile fabric.

In accordance to aspects of the present disclosure, of a single-strand multi-filament polyester yarn package or a multi-strand multi-filament polyester yarn package is configured for the weft insertion to enable inserting of the multi-filament polyester weft yarns during a single pick insertion event of the pick insertion apparatus of the loom apparatus. Further, the pick insertion apparatus is configured to convey at least two multi-filament polyester weft yarns across the warp shed of the loom apparatus through a set of warp yarns in the single pick insertion event of the pick insertion apparatus of the loom apparatus.

BRIEF DESCRIPTION OF THE DRAWINGS

The detailed description is described with reference to the accompanying figures. In the figures, the left-most digit(s) of a reference number identifies the figure in which the reference number first appears. The same numbers are used throughout the drawings to refer to like features and components.

DETAILED DESCRIPTION

Figure 1:
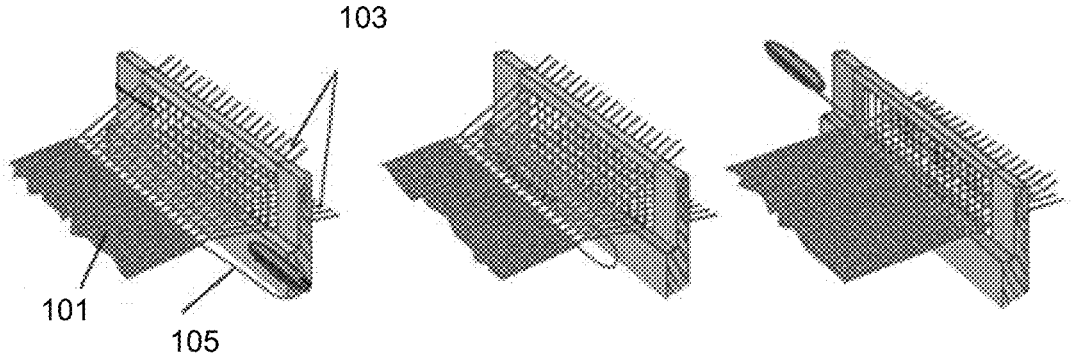
FIGS. 1(*a*), 1(*b*), and 1(*c*) illustrate different stages of a weaving process implemented using a weaving apparatus, in accordance with an embodiment of the present disclosure.

Some embodiments of this disclosure, illustrating all its features, will now be discussed in detail. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

It must also be noted that, the singular forms "a," "an," and "the" include plural references unless the context clearly dictates otherwise. Although any methods similar or equivalent to those described herein can be used in the practice or testing of embodiments of the present disclosure, the exemplary methods are now described. The disclosed embodiments are merely exemplary of the disclosure, which may be embodied in various forms.

Various modifications to the embodiment will be readily apparent to those skilled in the art and the generic principles herein may be applied to other embodiments. However, one of ordinary skill in the art will readily recognize that the present disclosure is not intended to be limited to the embodiments illustrated, but is to be accorded the widest scope consistent with the principles and features described herein.

Definitions

Terms used throughout this application are to be construed with ordinary and typical meaning to those of ordinary skill in the art. However, Applicants desire that the following terms be given the particular definition as defined below:

The terms EPI or "Ends per Inch" is the popular word in the garments & textile industry. Number of yarn in warp direction is measured by EPI. Normally, ends per Inch are the number of wrap threads. It is the represent vertical thread of the fabric. It is called the wrap yarn.

The term "warp" is the set of lengthwise yarns through which the weft is woven. Each individual warp thread in a fabric is called a warp end. Warp means "that which is thrown across".

The term "weft", also referred to as "filling", is the yarn that traverses the warp yarns (horizontally) during the weaving operation.

The term "picking" means inserting a weft thread across the warp through during weaving. Picking is the second primary motion in weaving.

The term "Airjet" or "Airjet loom" or "Airjet loom apparatus" is a shuttleless loom capable of very high speeds that use an air jet to propel the filling yarn through the shed.

The term "Rapier" or "Rapier loom" or "Rapier loom apparatus" is a shuttleless weaving loom in which the filling yarn is carried through the shed of warp yarns to the other side of the loom by fingerlike carriers called rapiers.

The term "plain weave", also called "Tabby weave", is a simplest and most common of the three basic textile weaves. The plain weave is made by passing each filling yarn over and under each warp yarn, with each row alternating, producing a high number of intersections.

The term "count" or "yarn count" refers to the thickness of a yarn and is determined by its mass per unit length. It is usually measured by the number of grams per one kilometer of yarn, a unit of measure called "Tex". However, the spinning industry tends to use English cotton count, which is determined by the number of yarn hanks (each 840 yards long) per pound of yarn, and is notated "Ne".

The term "denier" is a direct-management type, employed internationally to measure the size of silk and man-made filaments and yarns, and derived from an earlier system for measuring silk filaments (based on the weight in drams of 1,000 yards). The number denier indicates the weight in grams of 9,000 meters of filament or filament yarn. For example, if 9,000 meters of a yarn weighs 15 grams, it is a 15-denier yarn; if 9,000 meters of a yarn weighs 100 grams, it is a 100-denier yarn and much coarser than the 15-denier yarn. Thus, a smaller number indicates a finer yarn.

The term "multi strand yarn package" means where more than one yarn/thread is wound together on a yarn package.

The term "single strand yarn package" means where single yarn is wound on a yarn package.

While aspects of the described woven fabric textile and composition and method thereof may be implemented in any number of different systems, environments, and/or configurations, the embodiments may be described in the context of the following exemplary system.

Referring now to FIGS. 1(*a*), 1(*b*) and 1(*c*), different stages of a weaving process implemented using a weaving apparatus are illustrated, in accordance with an embodiment of the present disclosure As shown in FIG. 1(*a*), a woven fabric 101 is illustrated. In one embodiment, the woven fabric may be a woven fabric textile marketed and sold by the applicant herein by the trade name "Luxe Du Cotton". As shown, the woven fabric is usually longer in one direction than the other. The lengthwise threads are called the warps 103, while the other threads, which are combined with the warps 103 and lie widthwise, are called the wefts 105. It must be noted herein that the wefts are also referred to as "filling," "woof," and "shoot," or "shute". An individual thread from the warp, of indefinite length, is called an end. Further, each individual length of weft, extending from one edge of the fabric to the other, is called a pick, or shot. The consecutive picks are usually consecutive lengths of one piece of weft yarn that is repeatedly folded back on itself.

Typically, in the all known methods of weaving, before a length of weft is inserted in the warp, the warp is separated, over a short length extending from the fabric already formed, into two sheets. The process is called shedding (as indicated in FIG. 1(*a*)) and the space between the sheets is referred to as the shed. A pick of weft is then laid between the two sheets of warp, in the operation known as picking (as indicated in FIG. 1(*b*)). A new shed is then formed in accordance with the desired weave structure, with some or all of the ends in each sheet moving over to the position previously occupied by the other sheet. In this way, the weft is clasped between two layers of warp.

Since it is not possible to lay the weft close to the junction of the warp and the cloth already woven, a further operation called beating in, or beating up (as indicated in FIG. 1(*c*)), is necessary to push the pick to the desired distance away from the last one inserted previously. Although beating in usually takes place while the shed is changing, it is normally completed before the new shed is fully formed.

The sequence of primary operations in one weaving cycle is thus shedding (FIG. 1(*a*)), picking (FIG. 1(*b*)), and beating in (FIG. 1(*c*)). At the end of the cycle, the geometrical relation of the pick to the warp is the same as it would have been if the pick had been threaded through the spaces between alternate ends, first from one side of the fabric and then from the other, as in darning. This is the reason the weaving process is considered an interlacing method.

In accordance with embodiments of the present disclosure, a woven fabric with enhanced durability, softness, wrinkle resistance, strength, and low cost is proposed. The woven fabric comprises from 50 to 89 ends per inch warp yarns and from 200 to 1200 yarns per inch polyester weft yarns. The woven fabric may be made of fine polyester yarns having a denier of 10 to 60. The warp yarns may be made of cotton yarn. The yarn count on the warp may be within a range of 20-40 count (Ne).

In accordance with embodiments of the present disclosure, the weaving method of the fabric may include utilizing a cotton yarn of count within a range of 20-40 in the warp 103, wherein the EPI the warp 103 is within a range of 50-89. In the weft insertion step, multiple threads (yarns) of fine polyester yarns 105 may be inserted via single pick insertion in the apparatus (also known as picking). In one embodiment, the apparatus may include an air jet or rapier. In alternative embodiments, the looming apparatus such as bullet, magnetic levitation bullet, water jet, sulzer loom, and the like may also be employed.

In one embodiment, one pick insertion may have 2-24 polyester yarns (threads) of denier 10-60 denier each. Therefore, in each pick insertion, 2-24 threads per inch may be added in the weft of the woven fabric. In one embodiment, the minimum number of threads added per inch during the picking process per inch may be 200 and maximum threads added per inch during the picking process per inch maybe 1200. The weft yarn overlaps the warp yarn in the apparatus, in a one up one down weave also known as plain weave. The weave enhances the strength of the fabric. The mixture of the two different yarns (i.e. polyester and cotton yarn) and the unique weave construction increases the softness and the richness of the fabric while keeping it light in weight & enhancing the wrinkle resistance of the fabric & makes it cost effective.

In one embodiment, a woven textile fabric includes from 50 to 89 ends per inch warp yarns and from 200 to 1200 yarns per inch multi-filament polyester weft yarns. The yarns are woven into the textile fabric (e.g., fabric 101) in groups of multi-filament polyester weft yarns 105 running in a parallel form to one another. The multi-filament polyester weft yarns 105 are wound parallel to each other.

In one embodiment, the multi-filament polyester weft yarns 105 are wound adjacent to one another to enable the simultaneous inserting of the multi-filament polyester weft yarns during a single pick insertion event of a pick insertion apparatus of a loom apparatus (e.g. air jet or rapier). In one embodiment, at least two multi-filament polyester weft yarns 105 wound using the single pick insertion and in a substantially parallel form to one another and substantially adjacent to one another.

In one embodiment, the multi-filament polyester weft yarns 105 are wound at an angle of within a predefined range of 15 and 30 degrees to enable the simultaneous inserting of the multi-filament polyester weft yarns 105 during the single pick insertion event of the pick insertion apparatus.

In one embodiment, the woven textile fabric (e.g., fabric 101) may be made of multi-filament polyester yarns 105 having a denier of 10 to 60. In one embodiment, the warp yarns 103 may be made of cotton yarn. In one embodiment, the woven textile fabric (e.g., fabric 101) may have a total thread count from 250 to 1250. In one embodiment, the yarn count on the warp is between 20-40 (Ne) count.

In another embodiment, a method of a woven textile fabric (e.g., fabric 101) includes forming 250 to 1250 threads per inch fine textile fabric. The method forms the woven textile having from 50 to 89 ends per inch warp yarns 103 and from 200 to 1200 yarns per inch multi-filament polyester weft yarns 105. The yarns are woven into the textile fabric 101 using multi-filament polyester weft yarns. Additionally, the method may include inserting of the multi-filament polyester weft yarn during a single pick insertion event of a pick insertion apparatus of a loom apparatus.

Additionally, the method also includes conveying by the pick insertion apparatus the multiple polyester weft yarns across a warp shed of the loom apparatus through a set of warp yarns 105 in a single pick insertion event of the pick insertion apparatus of the loom apparatus. Further, the method may include beating the multiple polyester weft yarns into a fell of the fabric (e.g., fabric 101) with a reed apparatus (not shown) of the loom apparatus such that the set of warp yarns 103 and/or the multiple polyester weft yarns 105 become interlaced into a woven textile fabric 101, according to one embodiment.

Figure 2:
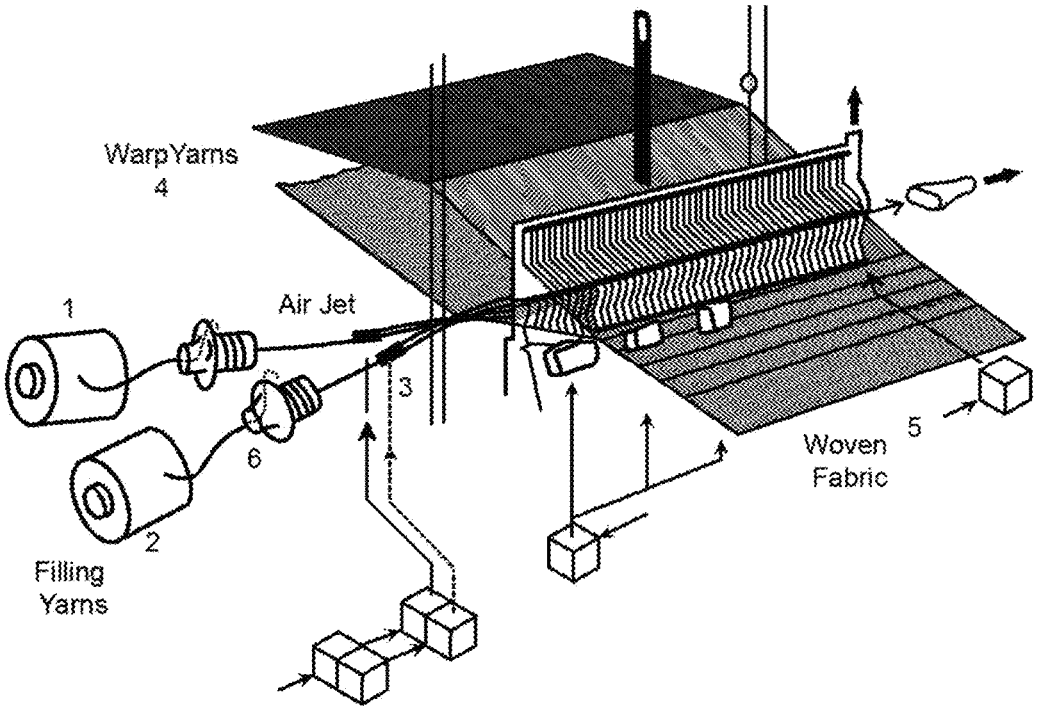
FIG. 2 illustrates a weaving process implemented using a weaving apparatus, in accordance with another embodiment of the present disclosure.

FIG. 2 illustrates a weaving process implemented using a weaving apparatus, in accordance with another embodiment of the present disclosure. In accordance with this embodiment as shown in FIG. 2, a woven fabric with enhanced durability, softness, wrinkle resistance, strength, and low cost is proposed. The woven fabric comprises from 50 to 89 ends per inch warp yarns (indicated with reference numeral 4 in FIG. 2) and from 200 to 1200 yarns per inch polyester weft yarns. The woven fabric may be made of fine polyester yarns having a denier of 10 to 60. The warp yarns may be made of cotton material. The yarn count on the warp may be within a range of 20-40 count (Ne).

In accordance with the embodiment shown in FIG. 2, the weaving method of the fabric may include utilizing cotton yarn of count within a range of 20-40 in the warp (indicated with reference numeral 4 in FIG. 2), wherein the EPI the warp is within a range of 50-89. In the weft insertion step, multiple threads (yarns) of fine polyester yarns (indicated with reference numerals 1 & 2 in FIG. 2) may be inserted via single pick insertion (indicated with reference numeral 3 in FIG. 2) in the apparatus (also known as picking). In one embodiment, the apparatus may include an air jet or rapier. In alternative embodiments, the looming apparatus such as bullet, magnetic levitation bullet, water jet, and the like may also be employed. A yarn package also known as cone (indicated with reference numeral 1 in FIG. 2) may contain at least one yarn and up to twelve yarns parallelly wound together.

In this embodiment, one pick insertion (also known as picking) may have 2-24 polyester yarns (threads) of denier 10-60 denier each. Therefore, in each pick insertion, 2-24 threads may be added in the weft of the woven fabric. In one embodiment, the minimum number of threads added per inch during the picking process per inch maybe 200 and maximum threads added per inch during the picking process per inch maybe 1200 in the weft. The weft yarn overlaps the warp yarn in the apparatus, in a one up one down weave also known as plain weave (indicated with reference numeral 5 in FIG. 2). The weave enhances the strength of the fabric. The mixture of the two different yarns (i.e. polyester and cotton) and the unique weave construction increases the softness and the richness of the fabric while keeping it light in weight & enhancing the wrinkle resistance of the fabric & makes it cost effective.

Exemplary embodiments discussed above may provide certain advantages including:

Some embodiments of the present disclosure enable in forming a woven fabric with long lasting durability.

Some embodiments of the present disclosure enable in forming a woven fabric having a courser count cotton yarn in warps, wherein the courser count cotton yarn has higher surface area and is a cheaper than finer cotton yarn yarns.

The coarser count cotton yarn increases the surface area covered by the yarn in the fabric. The viscose yarns are the softest material that can be used in textile and in the weaving process, a higher surface area is provided to the cotton yarn.

Some embodiments of the present disclosure enable in forming a woven fabric having a fine polyester yarn in wefts, wherein the finer polyester yarn is cheaper in comparison to any other material in fine count yarn, is smoother, has lower surface area per thread and is very strong. Further, the fine polyester yarns result in forming a wrinkle resistant, strong, smooth, and high thread count.

Some embodiments of the present disclosure enable in forming a woven fabric having a cotton yarn in warp, wherein the cotton yarn is softer, breathable, comfortable, and drapes well.

Some embodiments of the present disclosure enable in forming a woven fabric via combination of courser count cotton yarn on the warp and fine polyester yarns on the weft which makes the fabric naturally soft. The cotton yarn is courser thus covers higher surface area, while the super fine polyester yarn surface area per thread is lower and hence the air can easily pass around the super fine polyester threads and easily absorbed by the cotton yarn.

Although implementations for apparatus(s) and method(s) of forming a woven fabric textile with high thread count, enhanced durability, softness, wrinkle resistance, strength, and low cost have been described in language specific to structural features and/or methods, it is to be understood that the implementations and/or embodiments are not necessarily limited to the specific features or methods described. Rather, the specific features and methods are disclosed as examples of implementations for forming a woven fabric textile with high thread count, enhanced durability, ultimate softness, wrinkle resistance, light in weight and low cost.

I claim:

1. A woven textile fabric, comprising:

cotton warp yarns within a predefined range of 50 to 82 ends per inch in the warp; and multi-filament polyester weft yarns within a predefined range of 300 to 1200 yarns per inch in the weft;

wherein the warp-to-fill ratio is within a predefined range of 1:6 to 1:20;

wherein the multi-filament polyester weft yarns are wound on a single-strand or multi-strand yarn package at an angle of between 15 and 30 degrees to enable simultaneous insertion of the multi-filament polyester weft yarns during a single pick insertion event of the pick insertion apparatus of the loom apparatus, wherein at least one single-strand yarn package or at least one multi-strand yarn package or a combination thereof is configured for the weft insertion during the single pick insertion event of the pick insertion apparatus of the loom apparatus, wherein the cotton warp yarns are placed substantially parallel in a reed apparatus of the loom apparatus during weaving by setting 1 yarn per dent in the reed apparatus of the loom apparatus, wherein the yarn count on the cotton warp is between 20-40 (Ne) count, and wherein a total thread count of the textile fabric is within a predefined range of 350 to 1250 per inch.

2. The woven textile fabric of claim 1, wherein the pick insertion apparatus of the loom apparatus is at least one of an air jet pick insertion apparatus or a rapier pick insertion apparatus.

3. The woven textile fabric of claim 1, wherein the multi-filament polyester yarns have a denier within a predefined range of 10 to 60.

4. The woven textile fabric of claim 1, wherein in each single pick insertion, 2-24 threads are added in the weft of the woven fabric.

5. The woven textile fabric of claim 1, wherein the minimum and the maximum number of threads added per inch during the picking process per inch is 300 and 1200 respectively in the weft.

6. The woven textile fabric of claim 1, wherein the fabric is weaved in form of a weave pattern wherein at least two multi-filament polyester weft yarns in the single pick insertion event are interlaced on the warp threads in an alternate order of 1 up and 1 down.

7. The woven textile fabric of claim 1, wherein the textile fabric formed has wrinkle resistance.

8. A method of forming woven textile fabric, comprising:

forming cotton warp yarns within a predefined range of 50 to 82 ends per inch in the warp; and forming multi-filament polyester weft yarns within a predefined range of 300 to 1200 yarns per inch in the weft;

wherein the warp-to-fill ratio is within a predefined range of 1:6 to 1:20;

wherein at least one single-strand multi-filament polyester yarn package or at least one multi-strand multi-filament polyester yarn package or a combination thereof is configured for the weft insertion to enable inserting of the multi-filament polyester weft yarns during a single pick insertion event of the pick insertion apparatus of the loom apparatus, wherein the multi-filament polyester weft yarns is wound on the single-strand yarn package or the multi-strand yarn package at an angle of between 15 and 30 degrees to enable the simultaneous inserting of the multi-filament polyester weft yarns during the single pick insertion event of the pick insertion apparatus of the loom apparatus, wherein the pick insertion apparatus is configured to convey at least two multi-filament polyester weft yarns across the warp shed of the loom apparatus through a set of warp yarns in the single pick insertion event of the pick insertion apparatus of the loom apparatus, wherein the cotton warp yarns are placed substantially parallel in a reed apparatus of the loom apparatus during weaving by setting 1 yard per dent in the reed apparatus of the loom apparatus, wherein the fabric is weaved in form of a weave pattern wherein at least two multi-filament polyester weft yarns in the single pick insertion event are interlaced on the warp threads in an alternate order of 1 up and 1 down, wherein the yarn count on the cotton warp is between 20-40 (Ne) count, and wherein a total thread count of the textile fabric is within a predefined range of 350 to 1250 per inch.

9. The method of forming woven textile fabric as claimed in claim 8, wherein the multi-filament polyester yarns have a denier within a predefined range of 10 to 60.

10. The method of forming woven textile fabric as claimed in claim 8, wherein:

in each single pick insertion, 2-24 threads are added in the weft of the woven fabric.

11. The method of forming woven textile fabric as claimed in claim 8, wherein the minimum and the maximum number of threads added per inch in the weft during the picking process per inch is 300 and 1200 respectively.

12. A textile fabric weaving apparatus, comprising:

At least one single-strand multi-filament polyester yarn package or at least one multi-strand multi-filament polyester yarn package or a combination thereof is configured for weft insertion; and a loom apparatus, wherein the loom apparatus comprises a pick insertion apparatus and a warp shed, wherein the loom apparatus is configured to:

form 350 to 1250 threads per inch fine textile fabric;

form cotton warp yams within a predefined range of 50 to 82 ends per inch in the warp, wherein the yarn count on the cotton warp is between 20-40 (Ne) count; and form multi-filament polyester weft yarns within a predefined range of 300 to 1200 yarns per inch in the weft;

wherein the warp-to-fill ratio is within a predefined range of 1:6 to 1:20;

wherein the pick insertion apparatus is configured to convey at least two multi-filament polyester weft yams across the warp shed of the loom apparatus through a set of warp yarns in the single pick insertion event of the pick insertion apparatus of the loom apparatus; and wherein the cotton warp yarns are placed substantially parallel in a reed apparatus of the loom apparatus during weaving by setting 1 yarn per dent in the reed apparatus of the loom apparatus.

13. The textile fabric weaving apparatus of claim 12, wherein the pick insertion apparatus of the loom apparatus is at least one of an air jet pick insertion apparatus or a rapier pick insertion apparatus.

14. The textile fabric weaving apparatus of claim 12, wherein the multi-filament polyester weft yarns are wound on the multi-strand yarn package at an angle of between 15 and 30 degrees to enable the simultaneous inserting of the multi-filament polyester weft yarns during the single pick insertion event of the pick insertion apparatus of the loom apparatus.

15. The woven textile fabric of claim 12, wherein the fabric is weaved in form of a weave pattern wherein at least two multi-filament polyester weft yarns in the single pick insertion events are interlaced on the warp threads in an alternate order of 1 up and 1 down.

16. The woven textile fabric of claim 12, wherein the fabric is weaved either on air jet loom apparatus, rapier loom apparatus or sulzer loom apparatus.

* * * * *